US011059151B2

(12) United States Patent
Cummings et al.

(10) Patent No.: US 11,059,151 B2
(45) **Date of Patent: *Jul. 13, 2021**

(54) IMPACT SOCKET

(71) Applicant: Lowell Corporation, West Boylston, MA (US)

(72) Inventors: David S. Cummings, Princeton, MA (US); Derek Silsby, Worcester, MA (US); Paul Carnes, North Dartmouth, MA (US)

(73) Assignee: Lowell Corporation, West Boylston, MA (US)

( * ) Notice: Subject to any disclaimer, the term of this patent is extended or adjusted under 35 U.S.C. 154(b) by 317 days.

This patent is subject to a terminal disclaimer.

(21) Appl. No.: 16/209,242

(22) Filed: Dec. 4, 2018

(65) Prior Publication Data

US 2019/0105759 A1 Apr. 11, 2019

Related U.S. Application Data

(63) Continuation of application No. 15/068,056, filed on Mar. 11, 2016, now Pat. No. 10,166,657, which is a continuation-in-part of application No. 14/046,473, filed on Oct. 4, 2013, now Pat. No. 9,283,661.

(60) Provisional application No. 61/710,297, filed on Oct. 5, 2012.

(51) Int. Cl.
*B25B 13/10* (2006.01)
*B25B 21/02* (2006.01)

(52) U.S. Cl.
CPC ..... *B25B 13/102* (2013.01); *B25B 21/02* (2013.01)

(58) Field of Classification Search
CPC ..... B25B 13/102; B25B 21/02
See application file for complete search history.

(56) References Cited

U.S. PATENT DOCUMENTS

| | | | | |
|---|---|---|---|---|
| 6,354,176 | B1 * | 3/2002 | Nordlin | B25B 13/06 81/121.1 |
| 7,654,175 | B2 * | 2/2010 | Hamon | B25B 13/102 81/125 |
| 8,196,495 | B2 * | 6/2012 | Chen | B25B 23/0035 81/437 |
| 10,166,657 | B2 * | 1/2019 | Cummings | B25B 13/102 |

* cited by examiner

*Primary Examiner* — David B. Thomas
(74) *Attorney, Agent, or Firm* — Duquette Law Group, LLC

(57) ABSTRACT

An impact socket includes a socket body having a first end and an opposing second end, the socket body defining a first fastener driving structure at the second end. The impact socket includes a collar assembly carried by the socket body, the collar assembly defining a second fastener driving structure. The collar assembly includes a support sleeve and a base sleeve that define a chamber configured to constrain movement of a securing mechanism relative to the socket body, the securing mechanism configured to selectively secure the collar assembly to the socket body when the collar assembly is disposed in at least one of a first position relative to the second end of socket body and a second position relative to the second end of socket body.

12 Claims, 12 Drawing Sheets

IMPACT SOCKET

RELATED APPLICATIONS

This patent application is a continuation application of U.S. patent application Ser. No. 15/068,056, filed on Mar. 11, 2016, entitled "Impact Socket" which is continuation-in-part of and claims the benefit of U.S. patent application Ser. No. 14/046,473, filed on Oct. 4, 2013, entitled "Impact Socket" which claims the benefit of U.S. Provisional Application No. 61/710,297, filed on Oct. 5, 2012, entitled "Impact Socket," the contents and teachings of each of which are hereby incorporated by reference in their entirety.

BACKGROUND

Conventional impact wrenches or impact guns are configured to deliver a relatively high output torque to associated impact sockets with minimum exertion by the user. For example, one end of a conventional impact socket is directly mounted to the drive shaft of an impact wrench while the opposing end of the impact socket is configured to engage a nut or bolt head. In use, pressurized air rotates a drive shaft of the impact wrench and provides a substantially precise output torque to the nut or bolt head via the impact socket.

SUMMARY

Conventional impact sockets suffer from a variety of deficiencies. For example, conventional impact sockets are sized and shaped to drive correspondingly-sized nuts or bolts. Accordingly, a one inch impact socket is configured to drive a one inch nut or bolt head while a 1⅛ inch impact socket is configured to drive a 1⅛ inch nut or bolt head.

In certain cases, an operator can encounter a variety of differently-sized nuts or bolt heads at a work site, such as fasteners having one inch and 1⅛ inch nuts or bolt heads. With conventional impact wrenches, operators are required to carry a relatively large number of impact sockets to a work site to accommodate a potentially wide variety of nut or bolt head sizes that can be encountered. Accordingly, there is an increased risk that the operator can lose or misplace one or more impact sockets of a set. Additionally, because conventional impact sockets are configured to drive only a single, correspondingly sized fastener, the operator can be required to repeatedly remove and attach appropriately sized impact sockets relative to the impact wrench over the course of a single job. This can reduce the operator's efficiency at the job site and can increase the overall costs in completing a task.

By contrast to conventional impact sockets, embodiments of the present innovation relate to an impact socket having a first end configured to mount to a drive shaft of an impact wrench and an opposing second end having a set of fastener driving structures. For example, the second end of the impact socket includes a collar assembly that defines one or more fastener driving structures at its distal end. The collar assembly is configured to move linearly between a first position and second position relative to a socket body of the impact socket. In the first position, the distal end of the collar assembly can extend beyond a distal end of the socket body such that a user can use the collar assembly fastener driving structure for driving a correspondingly sized nut or bolt head. In the second position, the distal end of the collar assembly is disposed proximal to the distal end of the socket body which also defines at least one fastener driving structure. With such positioning, the collar assembly exposes the distal end of the socket body and allows the user to utilize the socket body fastener driving structure for driving a correspondingly sized nut or bolt head.

Accordingly, the impact socket provides at least two distinct fastener driving structures at a single end. This configuration of the impact socket allows the user to select one of the fastener driving structures to drive a fastener without being required to remove the impact socket from the impact wrench. Accordingly, the configuration of the impact socket can improve operator efficiency and can reduce the risk of loss.

In one arrangement, an impact socket includes a socket body having a first end and an opposing second end, the socket body defining a first fastener driving structure at the second end and a collar assembly carried by the socket body, the collar assembly defining a second fastener driving structure. The collar assembly comprises a support sleeve and a base sleeve that define a chamber configured to constrain movement of a securing mechanism relative to the socket body, the securing mechanism configured to selectively secure the collar assembly to the socket body when the collar assembly is disposed in at least one of a first position relative to the second end of socket body and a second position relative to the second end of socket body.

In one arrangement, an impact socket, comprises a socket body having a first end and an opposing second end, the socket body defining a first fastener driving structure at the second end and a collar assembly carried by the socket body, the collar assembly defining a second fastener driving structure. The collar assembly comprises a base sleeve defining a chamber relative to the socket body and a support sleeve at least partially disposed within the chamber, the support sleeve configured to translate along a longitudinal axis of the socket body to selectively constrain movement of a securing mechanism relative to the socket body and allow movement of the securing mechanism relative to the socket body.

BRIEF DESCRIPTION OF THE DRAWINGS

The foregoing and other objects, features and advantages will be apparent from the following description of particular embodiments of the innovation, as illustrated in the accompanying drawings in which like reference characters refer to the same parts throughout the different views. The drawings are not necessarily to scale, emphasis instead being placed upon illustrating the principles of various embodiments of the innovation.

DETAILED DESCRIPTION

Figure 1:
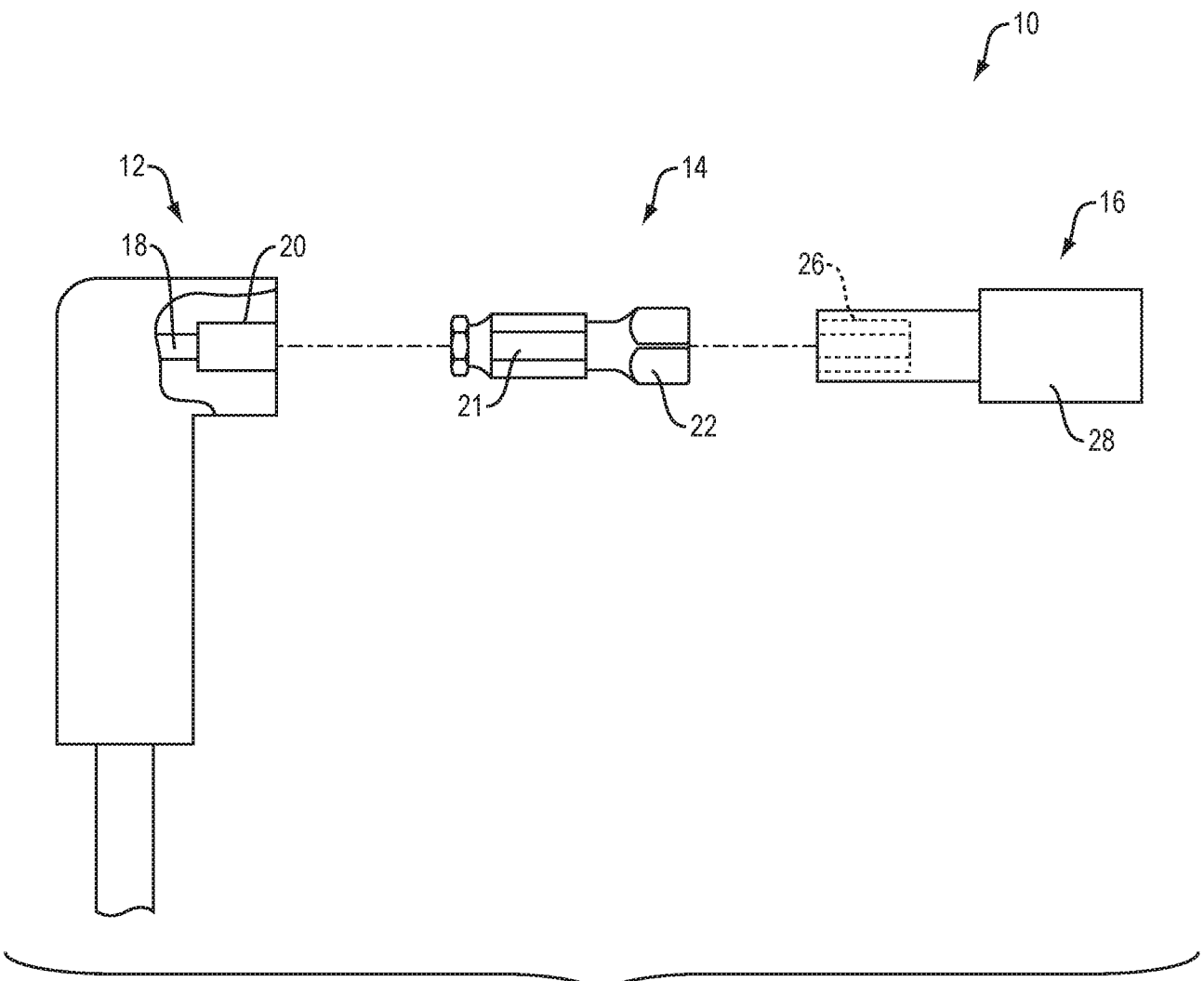
FIG. 1 illustrates a schematic representation of an exploded view of an impact wrench assembly, according to one arrangement.

FIG. 1 illustrates an example schematic representation of an exploded view of an impact wrench assembly 10. In one arrangement, the impact wrench assembly 10 includes an impact wrench 12, an adaptor 14, and an impact socket 16. The adaptor 14 is configured to couple a drive shaft 18 of the impact wrench 12 to the impact socket 16. In one arrangement, the drive shaft 18 includes a chuck 20 configured to receive a first end 24 of the adaptor 14 and secure the adaptor 14 to the impact wrench 12. A second end 22 of the adaptor 14 is configured to be inserted within a chamber 26 defined by the impact socket 16 and secured to the impact socket 16 via a fastening mechanism (not shown), such as a ball detent assembly, pin, or position lock for example. In use, a user operates the impact wrench 12 to cause the drive shaft 18 to rotate the impact socket 16 about a longitudinal axis 28.

In one arrangement, the impact wrench 12 generates a relatively large amount of torque on the impact socket 16. To withstand the relatively large amount of torque, the impact socket 16 is manufactured from a relatively strong material, such as a 4100/4300 high carbon alloy steel, for example.

FIGS. 2-6 illustrate an example of the impact socket 16 shown schematically in FIG. 1. As shown, the impact socket 16 includes a socket body 30 and a collar assembly 32 disposed thereon.

The socket body 30 includes a first end 33 configured to mount to a drive shaft 18 of an impact wrench 12 and an opposing second end 34 configured to drive a fastener. As indicated above, the first end 33 of the socket body 30 defines a chamber 26 configured to receive a second end 24 of an adaptor 14. In one arrangement, the first end 33 of the socket body 30 is configured to receive and be coupled to the first end 22 of the adaptor 14. For example, the first end 33 can define an opening 36 configured to receive a fastening mechanism such as a portion of a ball detent assembly, a pin, or a position lock (not shown). When the second end 24 of the adaptor 14 is disposed within the chamber 26, insertion of the fastening mechanism within the opening 36 couples or secures the adaptor 14 to the impact socket 16. Such coupling minimizes loosening of the adaptor 14 relative to the impact socket 16, thereby minimizing inadvertent decoupling of the impact socket 16 relative to the impact wrench 12.

In one arrangement, the opening 36 is defined within a groove or channel 37 extending about a circumference of the first end 33 of the socket body 30. The groove 37 allows a user to dispose an O-ring at the first end 33 of the socket body 30 to cover the opening 36 and fastening mechanism to minimize introduction of contaminants into the chamber 26.

Figure 3:
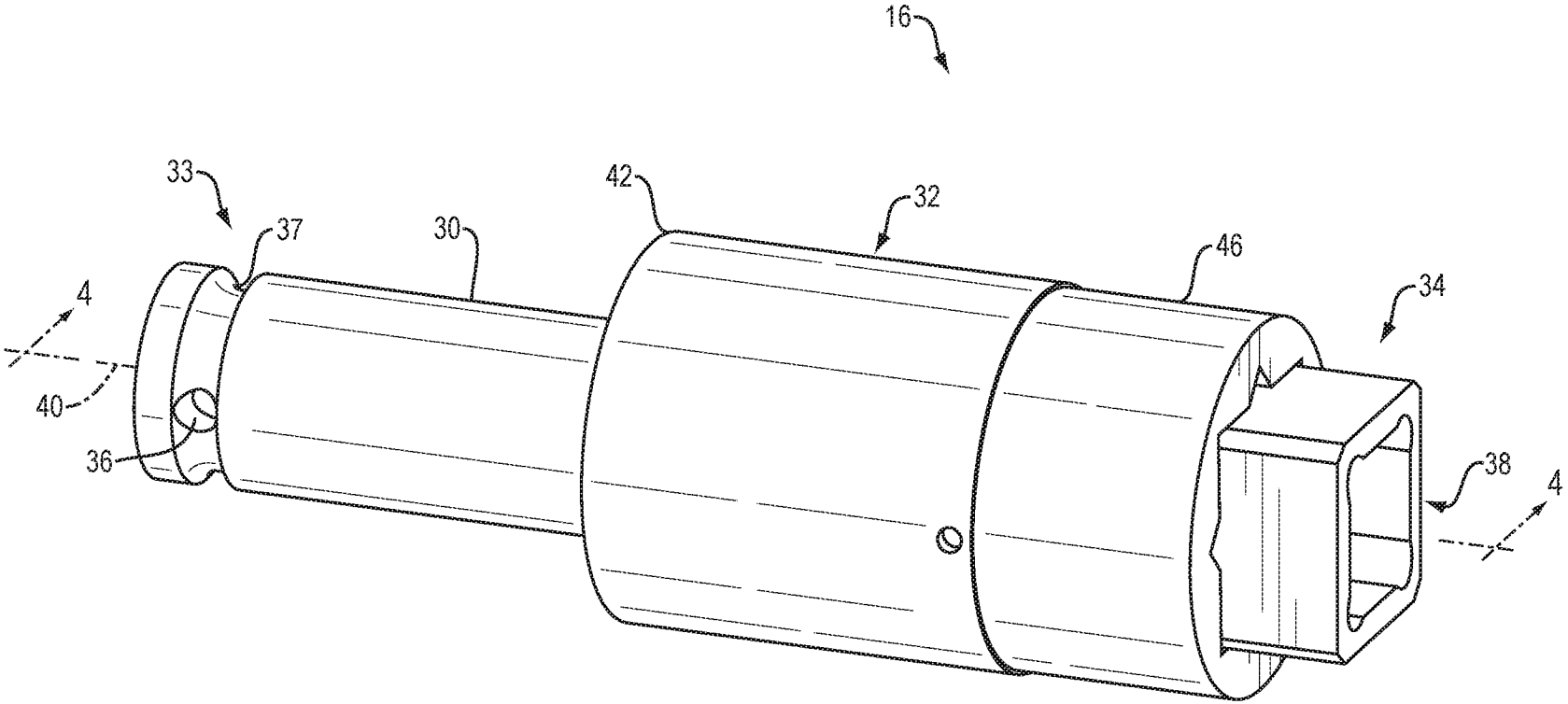
FIG. 3 illustrates the impact socket FIG. 2 having the collar assembly disposed in a second position along the longitudinal axis of the socket body, according to one arrangement.
Figure 4:
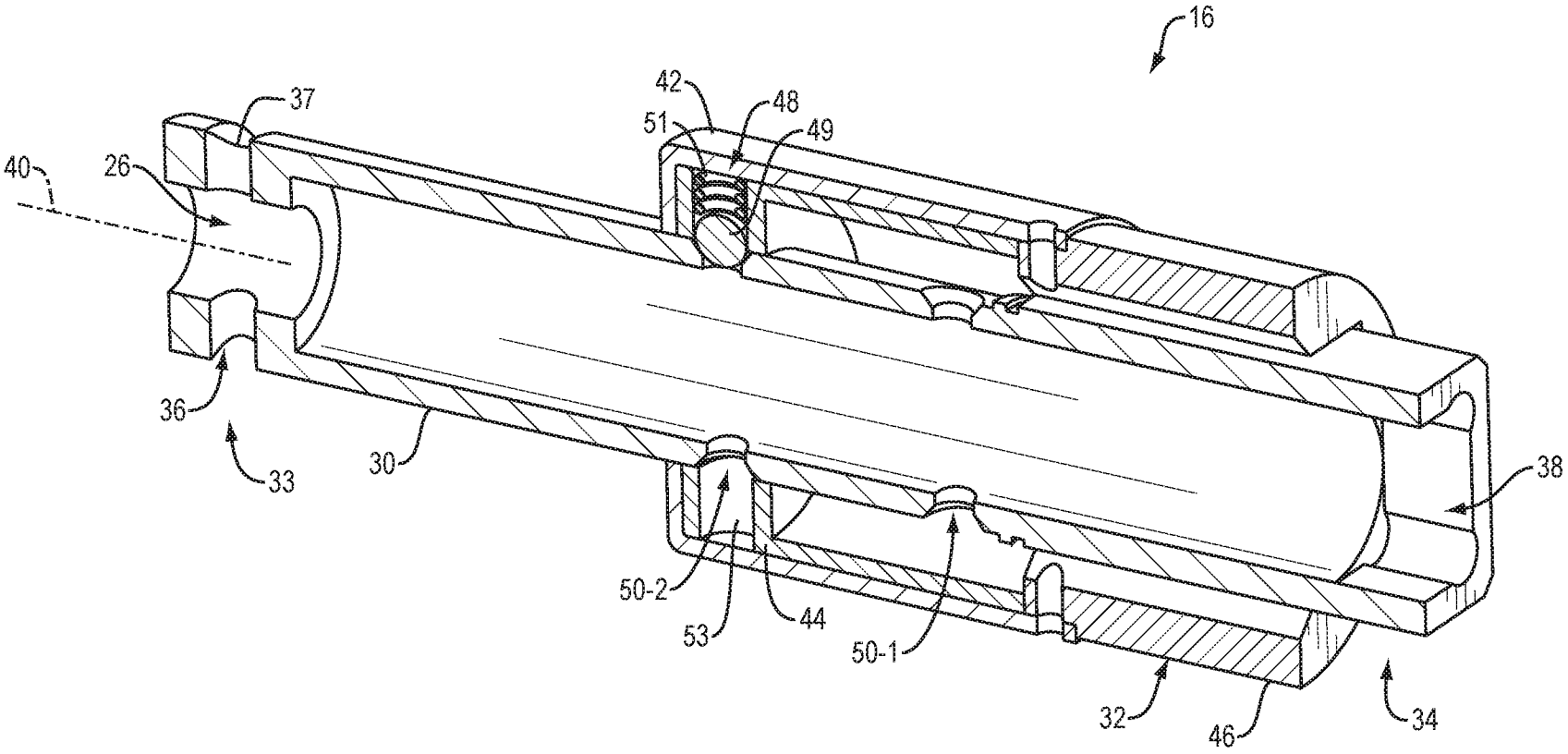
FIG. 4 illustrates a side sectional view of the impact socket shown in FIG. 3, according to one arrangement.

With particular reference to FIGS. 3 and 4, the socket body 30 defines at least one socket body fastener driving structure 38 at the opposing second end 34. While the body fastener driving structure 38 can be configured with a variety of geometries, in one arrangement and with reference to FIGS. 3-6, the socket body fastener driving structure 38 can be configured as a single, substantially square-shaped structure sized and shaped to receive a correspondingly sized and shaped fastener, such as a nut or bolt head. While the socket body fastener driving structure 38 can be configured in a variety of sizes, in one arrangement, the socket body fastener driving structure 38 is configured as having a ¾ inch square opening.

The collar assembly 32 is configured to translate longitudinally relative to a longitudinal axis 40 of the socket body 30. In one arrangement, the collar assembly 32 includes a securing mechanism 48 configured to selectively secure the collar assembly 32 to the socket body 30. For example, the securing mechanism can be configured as a ball 49 and spring mechanism 51 which selectively interfaces with detents 50 defined by the socket body 30, such as first detent 50-1 and second detent 50-2.

Figure 5A:
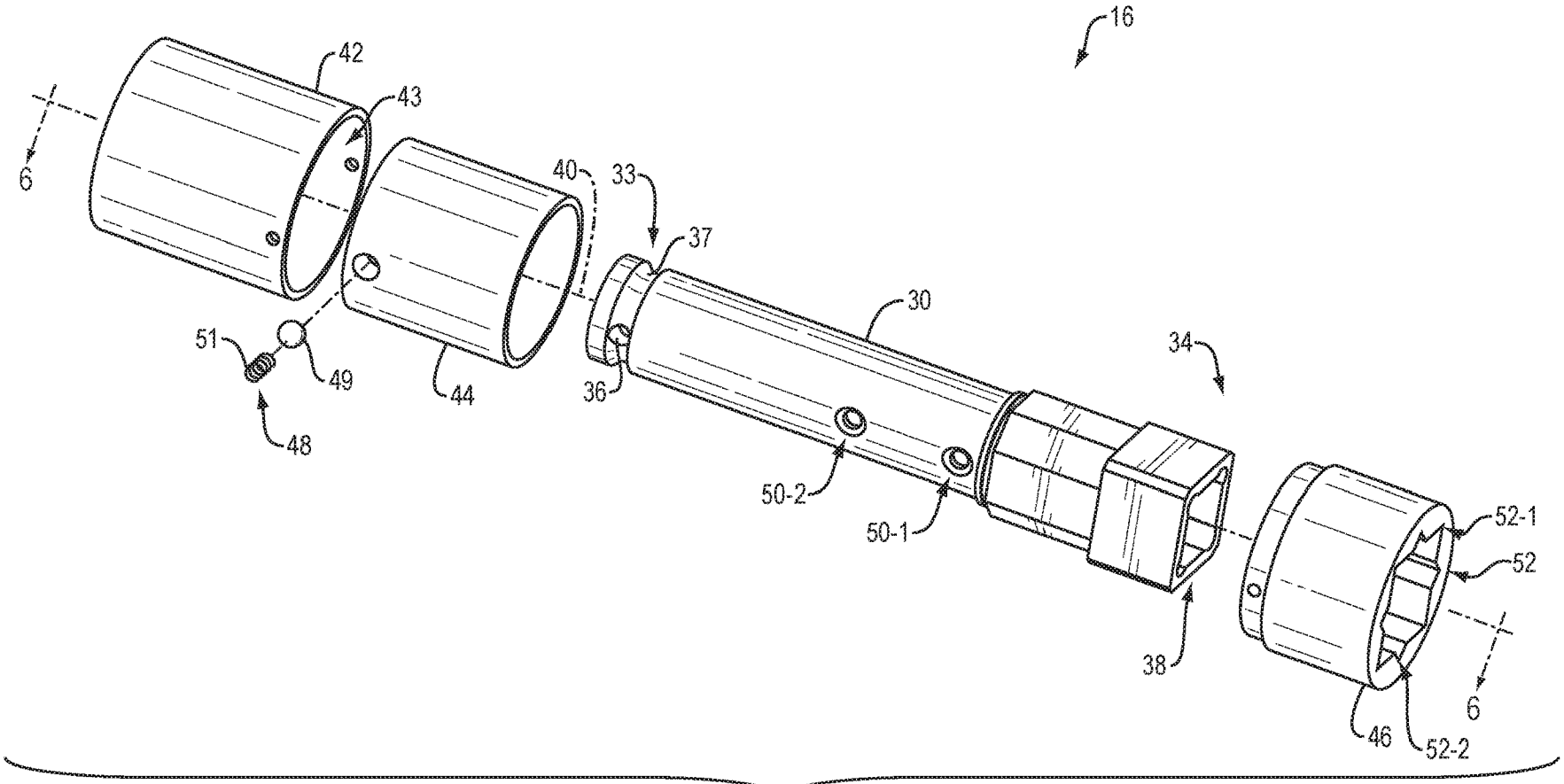
FIG. 5A illustrates an exploded view of the impact socket of FIG. 2, according to one arrangement.
Figure 5B:
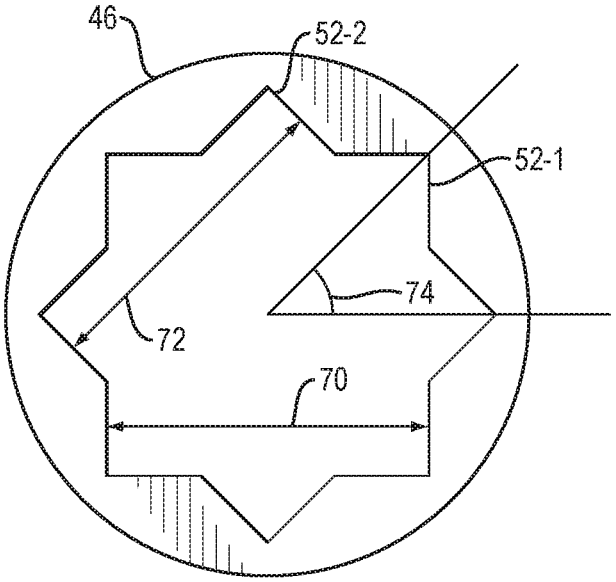
FIG. 5B illustrates a front end view of the impact socket of FIG. 2, according to one arrangement.
Figure 6:
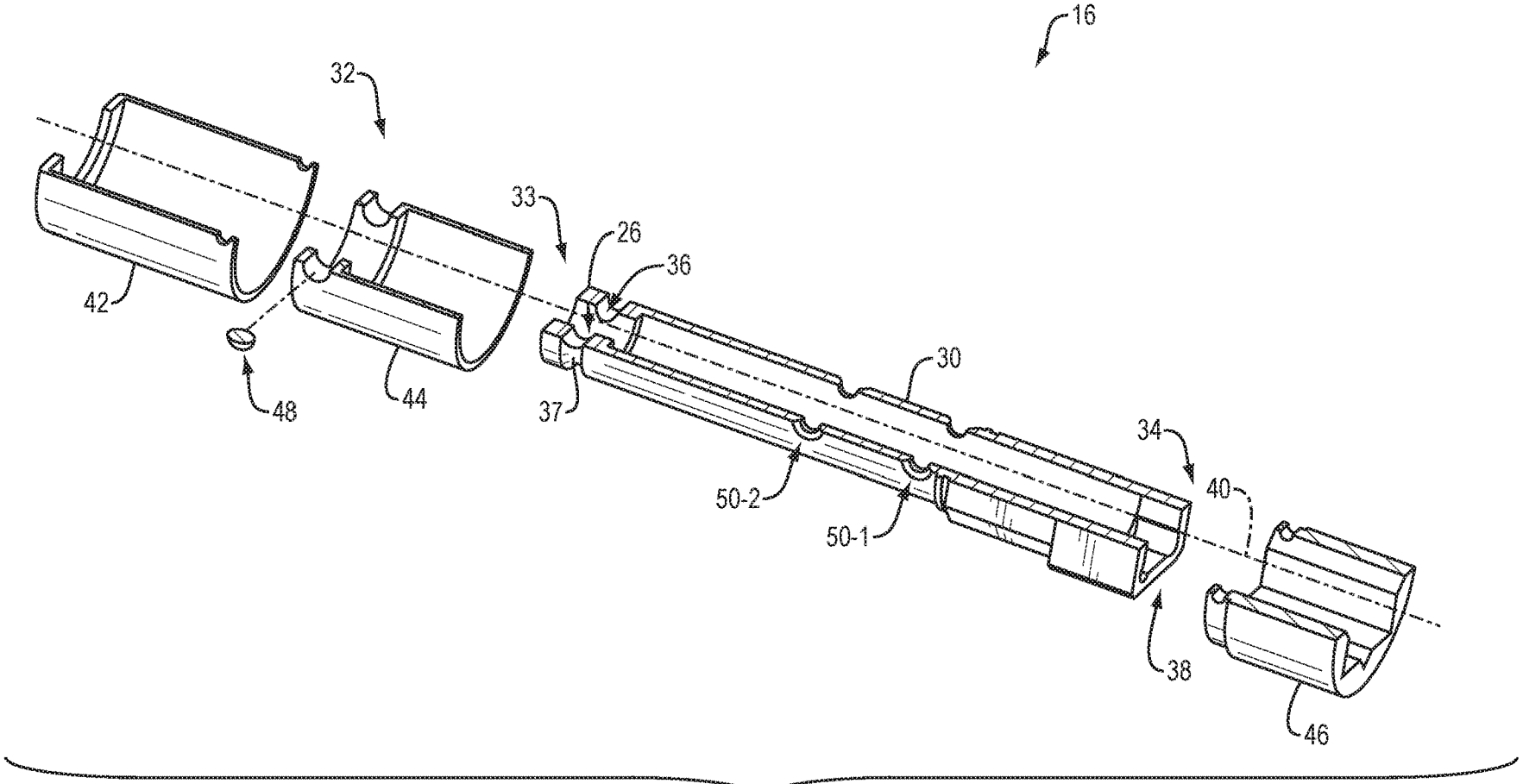
FIG. 6 illustrates a top sectional view of the impact socket illustrated in FIG. 5, according to one arrangement.
Figure 7:
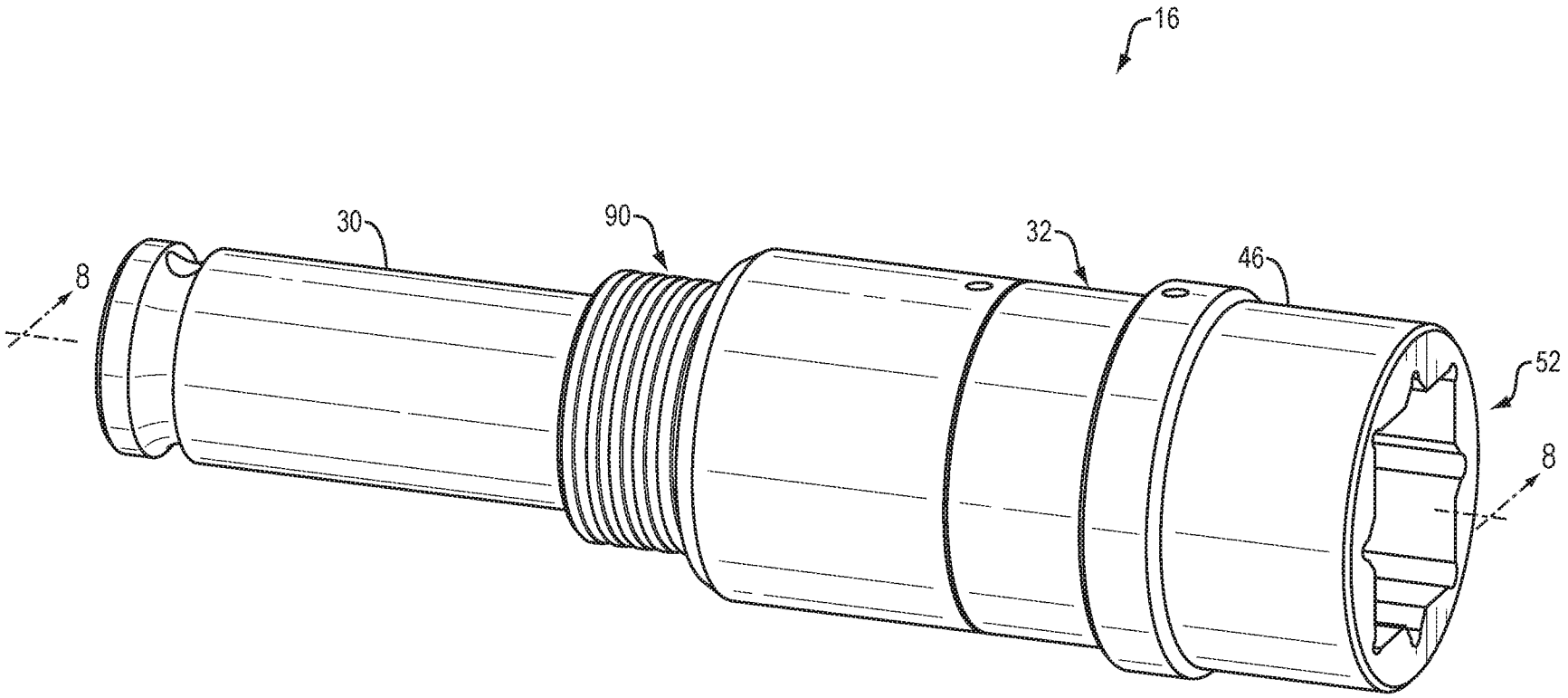
FIG. 7 illustrates a perspective view of an impact socket having a collar assembly disposed in a first position along a longitudinal axis of a socket body, according to one arrangement.

While the collar assembly 32 can be configured in a variety of ways, in one arrangement and with particular reference to FIGS. 4 through 6, the collar assembly 32 includes a base sleeve 42, a support sleeve 44, and a fastener driving sleeve 46.

In one arrangement, the base sleeve 42 and the support sleeve 44 are configured to maintain the positioning of the securing mechanism 48 relative to the socket body 30. For example, with reference to FIG. 4, the support sleeve 44 defines a chamber 53 which is configured, in part, to hold and constrain lateral movement of the ball 49 and spring mechanism 51 relative to the collar assembly 32. Additionally, as indicated in FIG. 5A, the support sleeve 44 is disposed within a chamber 43 defined by the base sleeve 42. Based upon the relative positioning of the support sleeve 44 and the base sleeve 42, the base sleeve 42 is configured as a cover for the chamber 53 to maintain the securing mechanism 48 therein.

The fastener driving sleeve 46 is coupled to the base sleeve 42 via a fastener and secures the support sleeve 44 within the chamber of the base sleeve 42. The fastener driving sleeve 46, in one arrangement, defines at least one collar assembly fastener driving structure 52 at its distal end. In one arrangement, with specific reference to FIGS. 2 and 5A, the fastener driving sleeve 46 defines two coaxially-aligned fastener driving structures, such as a first collar assembly fastener driving structure 52-1 and a second collar assembly fastener driving structure 52-2.

While the structures 52-1, 52-2 can be configured as a variety of different shapes, in one arrangement, each of the collar assembly fastener driving structures 52-1, 52-2 is defined as a substantially square-shaped structure that extends substantially along a length of the fastener driving sleeve 46. For example, each of the fastener driving structures 52-1, 52-2 defines four corners and four sides that extend along a length of the fastener driving sleeve 46, as indicated in FIG. 6. Accordingly, each of the fastener driving structures 52-1, 52-2 is configured to receive and substantially surround a correspondingly sized and shaped fastener, such as a nut or bolt head during operation.

The collar assembly fastener driving structures 52-1, 52-2 can be configured in a variety of sizes. With reference to FIG. 5B, in one arrangement, the first collar assembly fastener driving structure 52-1 is configured with a first opening size 70, such as a 1 inch square opening and the second collar assembly fastener driving structure 52-1 is configured with a second opening size 72 such as a 1⅛ inch square opening. Such a configuration allows an operator to adjust two differently sized fasteners at a worksite using a single fastener driving sleeve 46 without being required to remove and replace the impact socket 16 relative to the impact wrench 12.

In order to accommodate multiple fastener driving structures, the fastener driving sleeve 46 defines the first and second fastener driving structures 52-1, 52-1 as being rotationally offset from each other about the longitudinal axis 40 of the impact socket. For example, with continued reference to FIG. 5B, the fastener driving sleeve 46 defines the second fastener driving structure 52-2 as being rotationally offset by an angle 74 of about 45° relative to the first fastener driving structure 52-1.

Figure 2:
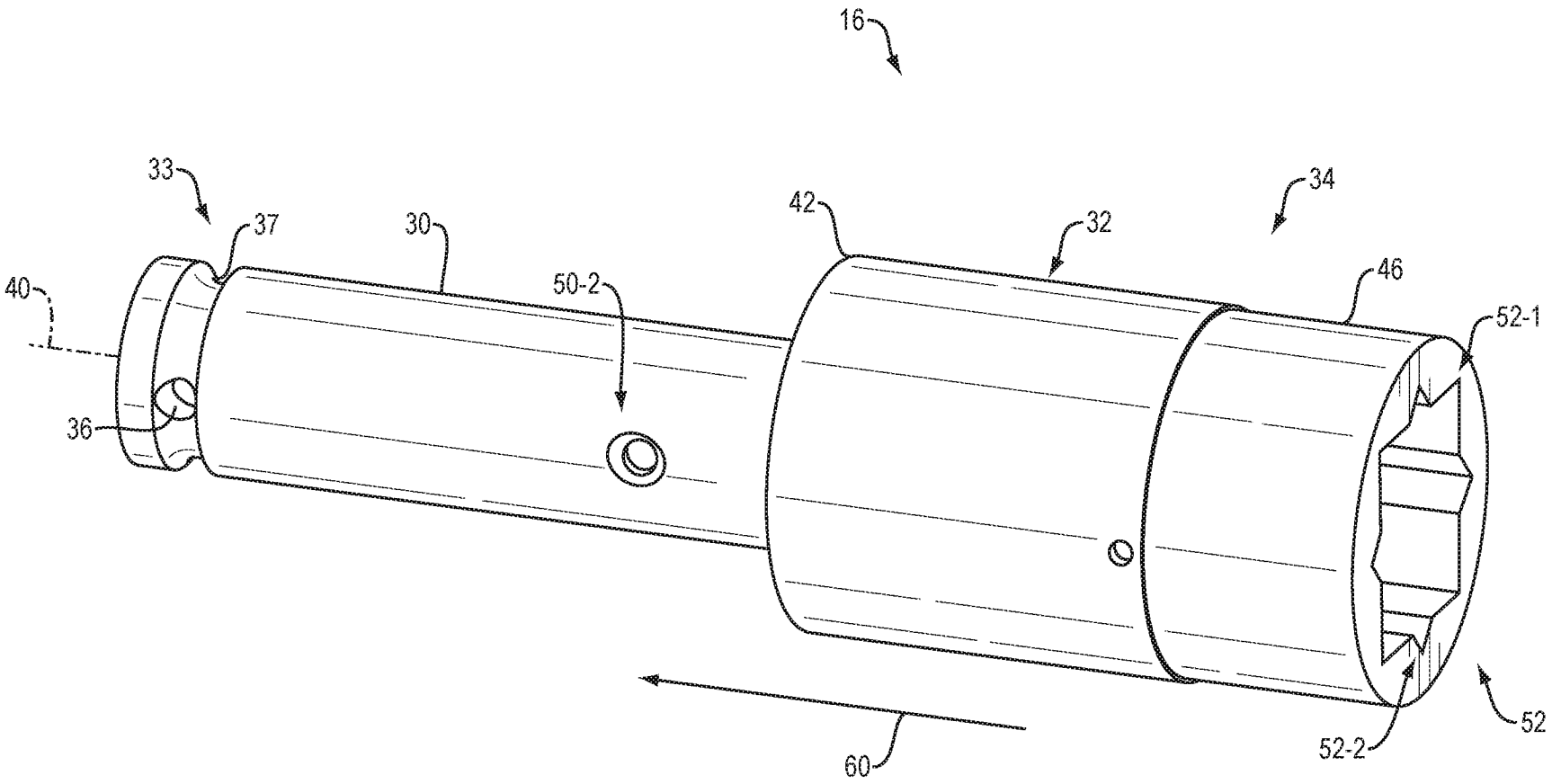
FIG. 2 illustrates a perspective view of an impact socket having a collar assembly disposed in a first position along a longitudinal axis of a socket body, according to one arrangement.

The collar assembly 32 is configured to move linearly between a first position, as shown in FIG. 2, and a second position, as shown in FIG. 3, relative to the socket body 30 of the impact socket 16 to provide a user with the distinctly-sized driving structures 38, 52 at a single end of the socket 16. In one arrangement, in the first position, a portion of the fastener driving sleeve 46 can be at least equidistant to a distal or second end 34 of the socket body 30 to expose the first and second fastener driving structures 52-1, 52-1 for use. For example, with reference to FIG. 2, the securing mechanism 48 is disposed within the first detent 50-1 of the socket body 30 to secure the relative position of the collar assembly 32 to the socket body 30. In this position, a portion of the fastener driving sleeve 46 can extend beyond a distal end 34 of the socket body 30 such that a user can select one of the two coaxially-aligned fastener driving structures 52-1, 52-2 for driving a correspondingly sized nut or bolt head.

The user can translate the collar 32 along direction 60, as shown in FIG. 2, for a given distance, such as a distance of about 2 inches, to place the collar assembly 32 in the second position. For example, by applying a translation force to the collar 32 relative to the socket body 30, the translation force can overcome the spring force generated by the spring 51 on the ball 49 to extract the ball 49 from the first detent 50-1 and allow the securing mechanism 48 to translate along the socket body 30 to the second detent 50-2. In the second position, with reference to FIGS. 3 and 4, the securing mechanism 48 is disposed within the second detent 50-2 of the socket body 30 to secure the relative positioning of the collar assembly 32 to the socket body 30. In this position, the fastener driving sleeve 46 is disposed proximal to the distal end 34 of the socket body 30 which exposes the socket body fastener driving structure 38 for use such that the user can drive a correspondingly sized nut or bolt head.

As indicated above, the impact socket 16 provides an operator with at least two distinctly sized fastener driving structures 38, 52, each of which defines an opening, such as a square opening. Such indication is by way of example only. In one arrangement, each fastener driving structure can define any opening shape, such as a hexagonally shaped opening, a pentagon shaped opening, or a custom spline shaped opening. Additionally, it should be noted that each of the fastener driving structures 38, 52 can have relatively different shaped openings. For example, the socket body fastener driving structure 38 can be configured with a pentagon shape and the collar assembly fastener driving structure 52 can be configured with a hexagonal shape. Alternately, for example, the socket body fastener driving structure 38 can be configured with a hexagonal shape and the collar assembly fastener driving structure 52 can be configured with a pentagon shape. Furthermore, in the case of the spline shaped opening, in one arrangement the socket body fastener driving structure 38 can be configured with a single spline that drives one or more nut or bolt head shapes (e.g., square and hexagonal shaped nuts) and the collar assembly fastener driving structure 52 can be configured with a single spline that drives one or more nut or bolt head shapes (e.g., square and hexagonal shaped nuts).

In another example, the collar assembly 32 is described as having two collar assembly fastener driving structures 52-1, 52-2. Such description is by way of example only. In one arrangement, the collar assembly 32 is configured with at least three collar assembly fastener driving structures.

In another example, the socket body 30 is described as defining a single socket body fastener driving structure 38. Such description is by way of example only. In one arrangement, the socket body 30 is configured with at least two socket body fastener driving structure 38.

Figure 8:
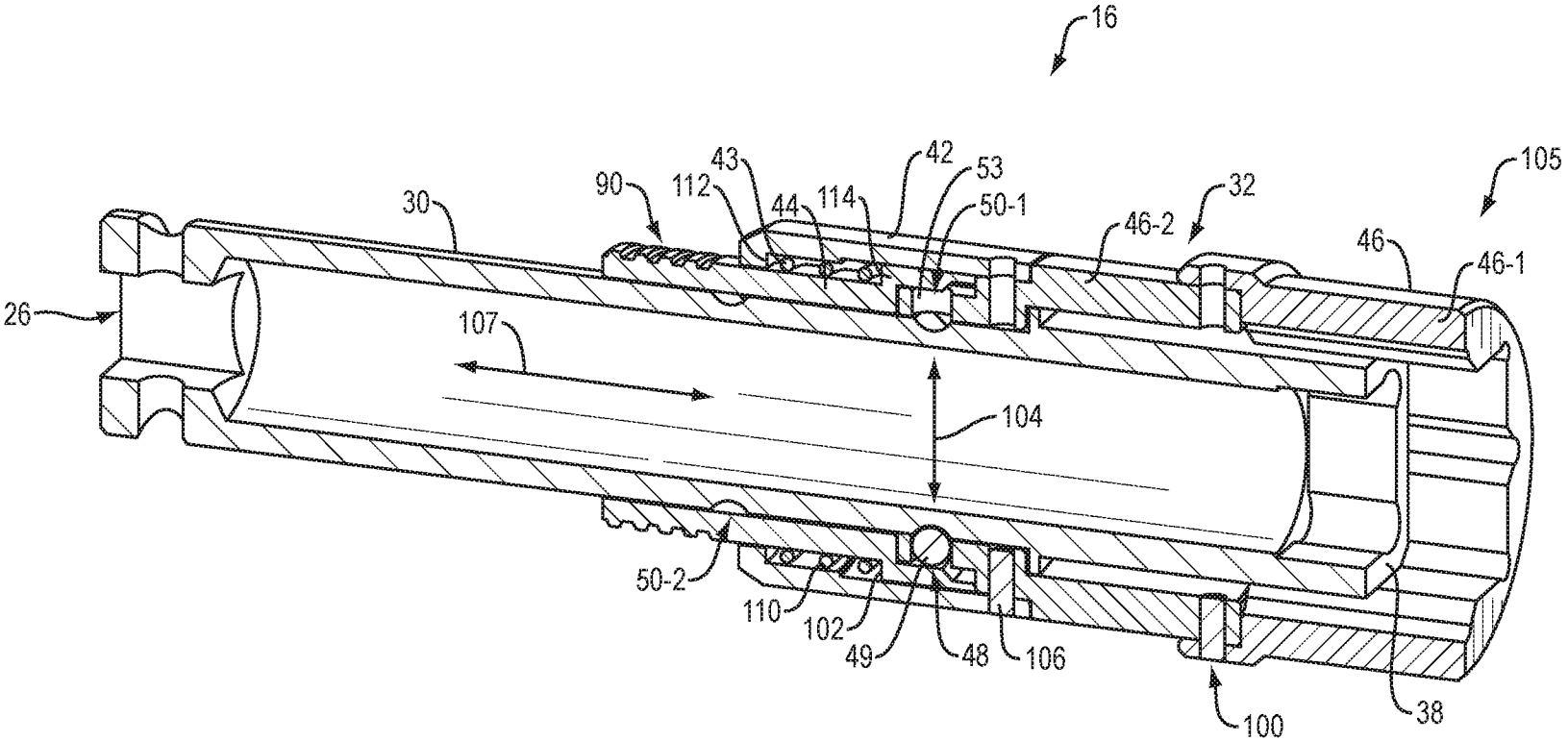
FIG. 8 illustrates a side sectional view of the impact socket shown in FIG. 7, according to one arrangement.

In another example, the first end 33 of the socket body 30 is described as defining a chamber 26 configured to receive a second end 24 of an adaptor 14. As indicated in FIG. 4, the chamber 26 is defined as a substantially cylindrically-shaped volume. Such illustration is by way of example only. In one arrangement, as indicated in FIG. 8, the chamber 26 is defined as a substantially rectangular volume. With such a configuration, the socket body can interface with the adaptor end 22, as illustrated in FIG. 1.

As provided above, with reference to FIGS. 4 and 5A for example, the collar assembly 32 includes a support sleeve 44 disposed within a chamber 43 defined by the base sleeve 42 and captured between the fastener driving sleeve 46 and the base sleeve 42. Connection of the fastener driving sleeve 46 and the base sleeve 42, such as via a pinned connection, secures the fastener driving sleeve 46 and the base sleeve 42 and secures the support sleeve 44 within the chamber 43. With such an arrangement, the base sleeve 42, support sleeve 44, and fastener driving sleeve 46 translate relative to the socket body 30 as a single unit. Such description and illustration are by way of example, however.

With reference to FIGS. 7 through 11, in one arrangement, the support sleeve 44 of the collar assembly 32 is configured to translate relative to the base sleeve 42, the fastener driving sleeve 46 and the socket body 30. As will be described below, linear translation of the support sleeve 44 selectively secures and releases the securing mechanism 59 relative to the socket body 30 of the impact socket 16. This, in turn, allows for selective movement of the fastener driving sleeve 46 between the first and second positions, such as described above.

Figure 9:
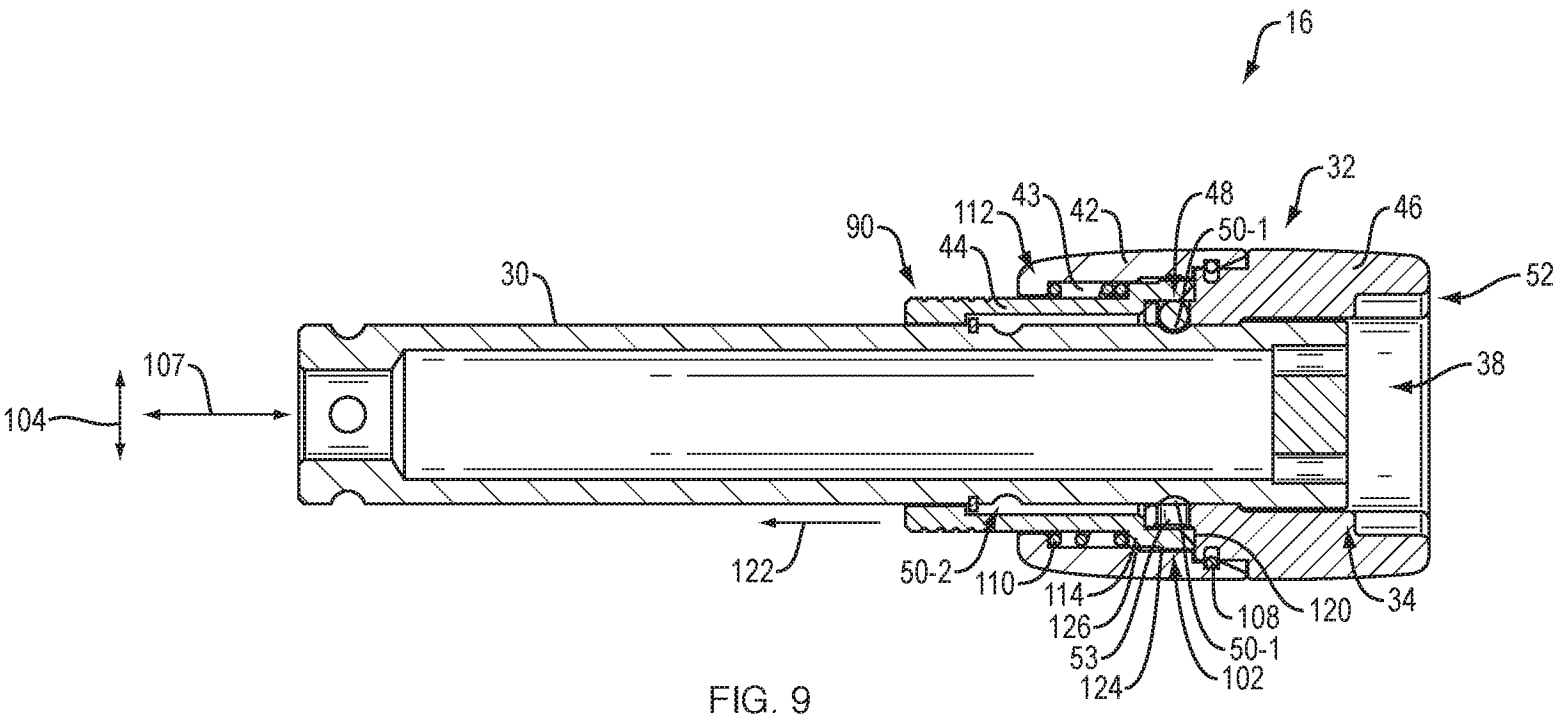
FIG. 9 illustrates a side sectional view of an impact socket having a collar assembly disposed in a first position along a longitudinal axis of a socket body, according to one arrangement.

With reference to the examples illustrated in FIGS. 8 and 9, the impact socket 16 includes the socket body 30 and collar assembly 32 where the collar assembly includes the base sleeve 42, support sleeve 44 and fastener driving sleeve 46.

The fastener driving sleeve 46 can be configured in a variety of ways. As illustrated in the example of FIG. 8, the fastener driving sleeve 46 can be configured as a multi-component structure, such as having a first sleeve portion 46-1 connected to a second sleeve portion 46-2 via a connection mechanism, such as a set of pins 100. As illustrated in the example FIG. 9, the fastener driving sleeve 46 is configured as a unitary structure, such as a cast structure.

As indicated in FIGS. 8 and 9, the securing mechanism 48 is disposed within, and carried by, the fastener driving sleeve 46. In one arrangement, the fastener driving sleeve 46 defines a set of chambers 53 extending about the periphery of a proximal end 102 the fastener driving sleeve 46. For example, the fastener driving sleeve 46 can define six chambers distributed in 60° increments about the periphery of the proximal end 102. Each chamber 53 is sized and shaped to contain a securing mechanism 48, such as a ball 49. As will be described below, each ball 49 is configured to translate within the corresponding chamber 53 along a lateral axis 104 of the socket body 30.

The fastener driving sleeve 46 is connected to the base sleeve 42 via a connecting mechanism 106. For example, in the arrangement illustrated in FIG. 8, the connecting mechanism 106 is configured as a set of pins that insert within aligned openings defined by the fastener driving sleeve 46 and the base sleeve 42. In another example, as shown in FIG. 9, the connecting mechanism 108 is configured as an outwardly-biased snap ring or spring ring that forms an interference fit between opposed and substantially aligned grooves defined by the fastener driving sleeve 46 and the base sleeve 42.

The base sleeve 42 defines a chamber 43 configured to contain the support sleeve 44 and to allow the support sleeve 44 to translate in a substantially linear manner relative to the socket body 30. For example, as illustrated in FIGS. 8 and 9, the support sleeve 44 is disposed within the chamber 43 and about the socket body 30.

The base sleeve 42 includes a spring 110, such as a compression spring, disposed within the chamber 43. For example, the spring 110 is disposed between a first shoulder portion 112 of the base sleeve 42 and a first shoulder portion 114 of the support sleeve 44. The spring 110 is configured to generate a compressive load against the first shoulder portion 112 and the second shoulder portion 114 to push the support sleeve 44 toward a distal end 105 of the impact socket 16 and against the securing mechanism 48.

Figure 10:
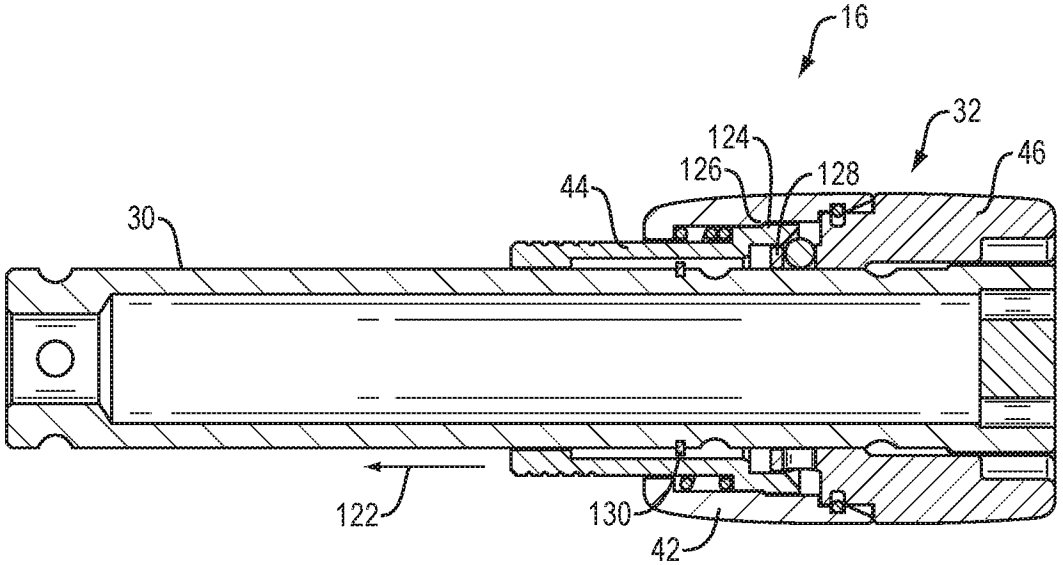
FIG. 10 illustrates a side sectional view of an impact socket having a collar assembly disposed between the first position and a second position along the longitudinal axis of the socket body, according to one arrangement.
Figure 11:
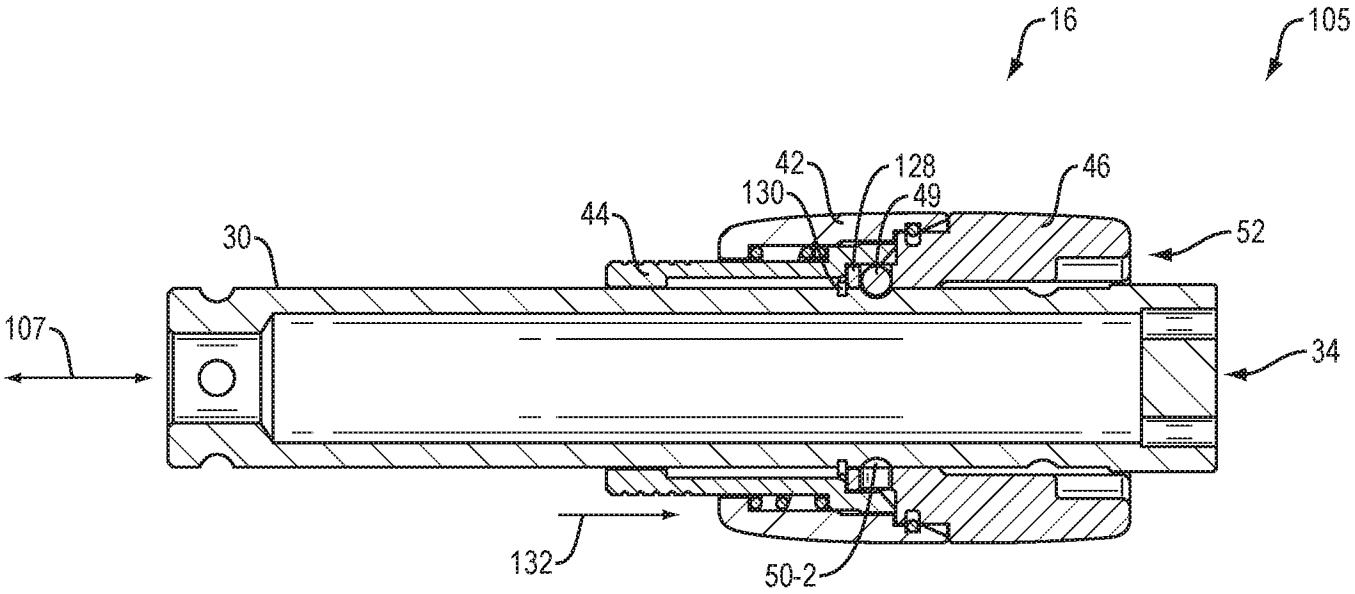
FIG. 11 illustrates a side sectional view of an impact socket having a collar assembly disposed in the second position along the longitudinal axis of the socket body, according to one arrangement.

The support sleeve 44 is configured to translate within the chamber 43 and relative to the socket body 30 along longitudinal axis 105. With such translation, the support sleeve 44 is configured to selectively capture and release the securing mechanism 48 to allow the collar assembly 32 to translate between a first position (FIGS. 8 and 9) and a second position (FIG. 11). Such selective positioning provides a user with one of the distinctly-sized driving structures 38, 52 at a single end of the impact socket 16. Operation of the support sleeve 44, according to one arrangement, is provided with reference to FIGS. 9 through 11 and described below.

As illustrated in FIG. 9, for example, the spring 110 generates a load against the first shoulder 112 of the base sleeve 42 and against the first shoulder 114 of the support sleeve 44. In response to the loading from the spring 110, the support sleeve 44 generates a corresponding load against a shoulder portion 120 of the fastener driving sleeve 46 and positions a securing mechanism 48, such as the ball 49, within a corresponding first detent 50-1 of the socket body 30, such as an annular groove defined by the socket body 30. For example, a portion of the support sleeve 44 extends over each ball 49 and generates a load on the corresponding ball 49 substantially along the lateral axis 104 toward a centerline of the socket body 30. Such loading causes the ball 49 to translate within the chamber 53 of the fastener driving sleeve 46 along lateral axis 104 and into the first detent 50-1 of the socket body 30. With such positioning, the support sleeve 44 maintains a portion of each ball 49 within the corresponding first detent 50-1 and maintains a portion of each ball within the chamber 53 of the fastener driving sleeve 46. Such positioning couples the fastener driving sleeve 46 to the socket body 30 and limits longitudinal translation of the fastener driving sleeve 46 relative to the socket body 30. Accordingly, when disposed in the first position as illustrated in FIG. 9, the support sleeve 44 maintains the collar assembly 32 in the first position such that the driving structure 52 extends beyond the second end 34 of the socket body 30.

With continued reference to FIG. 9, the support sleeve 44 is configured to allow an operator to position the collar assembly 32 between the first position and the second position, as illustrated in FIG. 11. For example, in use, the operator can grasp the fastener driving sleeve 46 with one hand and grasp the support sleeve 44 along a set of ridges 90 disposed at least partly about an outer surface of the support sleeve 44 with another hand. The operator then generates a linear force on the support sleeve 44 along direction 122 to overcome the compressive force generated by the spring 110 and to translate the support sleeve 44 until a second shoulder portion 124 of the support sleeve 44 contacts a second shoulder portion 126 of the base sleeve 42, as indicated in FIG. 10. With such positioning, the support sleeve 44 uncovers each ball 49 from the corresponding chamber 53.

Additionally, translation of the support sleeve 44 along direction 122 causes the second shoulder portion 124 of the support sleeve 44 to abut the second shoulder portion 126 of the base sleeve 42. With such interaction, further translation of the support sleeve 44 along direction 122 causes the base sleeve 42 and the fastener driving sleeve 46 to translate along the same direction 122, as well. For example, the operator can continue to translate the support sleeve 44 along direction 122 to move the entire collar assembly 32 relative to the socket body 30.

As the operator utilizes the support sleeve 44 to translate the fastener driving sleeve 46 along direction 122, such motion causes each ball 49 to translate with the fastener driving sleeve 46 along direction 122. As such, each ball 49 exits the first detent 50-1 and translates within the chamber 53 of the fastener driving sleeve 46 along lateral axis 104 away from the centerline of the socket body 30. The motion of the support sleeve 44 along direction 122, therefore, decouples the fastener driving sleeve 46 from the socket body 30.

The operator can continue to translate the collar assembly 32 along direction 122 until a stop portion 128 associated with the support sleeve 44 abuts a stop portion 130 associated with the socket body 30, as shown in FIG. 11. With such positioning of the opposed stop portions 128, 130, the securing mechanisms 48, or balls 49, align with a second detent 50-2 of the socket body 30, such as an annular groove defined by the socket body 30. As the operator releases the support sleeve 44, in response to the loading from the spring 110, the support sleeve 44 translates along direction 132, generates a corresponding load against a shoulder portion 120 of the fastener driving sleeve 46, and positions the ball 49 within the corresponding second detent 50-2 of the socket body 30. A portion of the support sleeve 44 extends over each ball 49 and generates a load on the corresponding ball 49 substantially along the lateral axis 104 toward a centerline of the socket body 30. Such loading causes the ball 49 to translate within the chamber 53 of the fastener driving sleeve 46 along lateral axis 104 and into the second detent 50-2 of the socket body 30. With such positioning, the support sleeve 44 maintains a portion of each ball 49 within the corresponding second detent 50-2 and maintains a portion of each ball within the chamber 53 of the fastener driving sleeve 46. Such positioning couples the fastener driving sleeve 46 to the socket body 30 and limits longitudinal translation of the fastener driving sleeve 46. Accordingly, when disposed in the second position as illustrated in FIG. 11, the support sleeve 44 maintains the collar assembly 32 in the second position such that second end 34 of the socket body 30 extends past the driving structure 52.

To reverse positioning of the collar assembly 32 from the second position shown in FIG. 11 to the first position shown in FIG. 9, the operator generates a linear force on the support sleeve 44 along direction 122 to overcome the compressive force generated by the spring 110. While maintaining the force on the support sleeve 44, the operator translates the collar assembly 32 (i.e., the base sleeve 42, fastener driving sleeve 46, and support sleeve 44) along direction 132 until the balls 49 align with the first detent 50-1. The operator can then release the linear force from the support sleeve 44 to cause a portion of the support sleeve 44 to extend over each ball 49 and generate a load on the corresponding ball 49 substantially along the lateral axis 104 toward a centerline of the socket body 30. Such loading causes the ball 49 to translate within the chamber 53 of the fastener driving sleeve 46 along lateral axis 104 and into the first detent 50-1 of the socket body 30.

While various embodiments of the innovation have been particularly shown and described, it will be understood by those skilled in the art that various changes in form and details may be made therein without departing from the spirit and scope of the innovation as defined by the appended claims.

What is claimed is:

1. An impact socket, comprising:

a socket body having a first end and an opposing second end, the second end defining at least one socket body fastener driving structure;

a collar assembly carried by the socket body, the collar assembly defining at least one collar assembly fastener driving structure; and a spring carried by the collar assembly, the spring configured to load the collar assembly against the socket body when the collar assembly is disposed in (i) a first position relative to the socket body where a distal end of the collar assembly extends beyond a distal the second end of the socket body and (ii) a second position where the distal end of the collar assembly is disposed at least equidistant to the second end of the socket body.

2. The impact socket of claim 1, wherein the at least one socket body fastener driving structure defines a substantially square opening that extends along a longitudinal axis of the socket body.

3. The impact socket of claim 1, wherein the at least one collar assembly fastener driving structure defines a first fastener driving structure and a second fastener driving structure, the first fastener driving structure configured to drive a first sized fastener and the second fastener driving structure configured to drive a second sized fastener, the first sized fastener being distinct from the second sized fastener.

4. The impact socket of claim 3, wherein the at least one collar assembly fastener driving structure defines the first fastener driving structure at a rotational offset relative to the second fastener driving structure.

5. The impact socket of claim 1, wherein the first end of the socket body is configured to mount to a drive shaft of an impact wrench.

6. The impact socket of claim 1, wherein the spring comprises a compression spring.

7. An impact wrench assembly, comprising:

an impact wrench;

an impact socket, comprising:

a socket body having a first end and an opposing second end, the second end defining at least one socket body fastener driving structure, a collar assembly carried by the socket body, the collar assembly defining at least one collar assembly fastener driving structure, and a spring carried by the collar assembly, the spring configured to load the collar assembly against the socket body when the collar assembly is disposed in (i) a first position relative to the socket body where a distal end of the collar assembly extends beyond a distal the second end of the socket body and (ii) a second position where the distal end of the collar assembly is disposed at least equidistant to the second end of the socket body; and an adaptor configured to couple a drive shaft of the impact wrench to the impact socket.

8. The impact wrench assembly of claim 7, wherein the at least one socket body fastener driving structure defines a substantially square opening that extends along a longitudinal axis of the socket body.

9. The impact wrench assembly of claim 7, wherein the at least one collar assembly fastener driving structure defines a first fastener driving structure and a second fastener driving structure, the first fastener driving structure configured to drive a first sized fastener and the second fastener driving structure configured to drive a second sized fastener, the first sized fastener being distinct from the second sized fastener.

10. The impact wrench assembly of claim 9, wherein the at least one collar assembly fastener driving structure defines the first fastener driving structure at a rotational offset relative to the second fastener driving structure.

11. The impact wrench assembly of claim 7, wherein the first end of the socket body is configured to mount to the drive shaft of the impact wrench via the adaptor.

12. The impact wrench assembly of claim 7, wherein the spring comprises a compression spring.

* * * * *